United States Patent [19]

Atago et al.

[11] Patent Number: 4,723,524

[45] Date of Patent: Feb. 9, 1988

[54] FUEL INJECTION CONTROLLING METHOD FOR AN INTERNAL COMBUSTION ENGINE

[75] Inventors: Takeshi Atago; Masami Nagano; Masahide Sakamoto, all of Katsuta, Japan

[73] Assignee: Hitachi, Ltd., Tokyo, Japan

[21] Appl. No.: 931,041

[22] Filed: Nov. 17, 1986

Related U.S. Application Data

[63] Continuation of Ser. No. 741,346, Jun. 5, 1985, abandoned.

[51] Int. Cl.[4] ..... F02M 51/00

[52] U.S. Cl. ..... 123/492; 123/493

[58] Field of Search ..... 123/492, 493, 339, 340, 123/480, 486

[56] References Cited

U.S. PATENT DOCUMENTS

| | | | |
|---|---|---|---|
| 4,508,086 | 4/1985 | Ito et al. | 123/492 |
| 4,561,405 | 12/1985 | Simons | 123/492 |
| 4,573,443 | 3/1986 | Watanabe et al. | 123/492 |
| 4,590,912 | 5/1986 | Atago | 123/492 |
| 4,640,254 | 2/1987 | Ninomiya | 123/492 |
| 4,643,152 | 2/1987 | Yamato | 123/492 |

*Primary Examiner*—Raymond A. Nelli

*Attorney, Agent, or Firm*—Antonelli, Terry & Wands

[57] ABSTRACT

In a fuel injection controlling method for an internal combustion engine having the hot were air flow meter and the valve opening pulse generating means for a fuel increment independently of the basic valve opening pulse generating means for causing the injector to inject fuel normally during the normal condition, the valve opening pulse for a fuel increment has a duration dependent on at least one of selected from variations in the air intake volume per unit time, a closing signal of the idle switch for the throttle valve, a signal indicating the number of revolutions of the engine, etc., independently of the duration of the basic valve opening pulse. The acceleration adjustment is adjusted the fuel increment in accordance with the valve opening pulse for a fuel increment. It is possible to obtain optimum acceleration by varying the adjustment depending on conditions for interrupt adjustment during acceleration. By applying the judgment of conditions for adjustment after fuel reduction for deceleration, it has become possible to acceleration matching between the state after deceleration and the state after normal operation.

7 Claims, 5 Drawing Figures

FUEL INJECTION CONTROLLING METHOD FOR AN INTERNAL COMBUSTION ENGINE

This is a continuation of application Ser. No. 741,346, filed June 5, 1985, now abandoned.

BACKGROUND OF THE INVENTION

The present invention relates to a fuel injection controlling method for an internal combustion engine, and more particularly, to a fuel injection controlling method for an internal combustion engine for automobiles using a hot wire air flow meter wherein the rate of fuel injection can be adjusted during acceleration.

In, for example, Japanese Laid Open Patent Publication No. 5841/1984, a conventional acceleration adjustment in fuel injection devices of the internal combustion engine for automobiles has been provided wherein the valve opening pulse generating means for the fuel increment is independent of the basic valve opening pulse for causing the injectors to inject fuel normally during the normal condition, and the valve opening pulse for the fuel increment is determined for a duration dependent on the water temperature of the internal combustion engine.

However, the above acceleration adjustment in fuel injection devices has not provided fine adjustment of the fuel increment pulse depending on the state of a running engine excepting the water temperature.

The above electronic fuel injector (MPI system) employs a vane air flow meter. Therefore, it can not abruptly increase the rate of air intake into an engine during acceleration. From this reason, a relatively rich mixture is supplied at the beginning of acceleration.

However, because an inherent density exists in air intake into the engine, it has been impossible to achieve abrupt acceleration. On the rapid acceleration from idling to the fully open state under no load, the speeded up revolution time (To) is about 200 ms.

Besides, a hot wire air flow meter employed in the air flow meter requires fine adjustment during acceleration, because it includes no member interrupting air intake as seen in the vane type air flow meter; hence, it causes an instantaneous flow of air into the engine.

The hot wire air flow meter which detects the volume of air is advantageous in that it allows air to be supplied to the engine more rapidly during acceleration because it has no throttle component. It does, however, have the problem of delayed fuel feed, that is, a lag in response time. This delay in fuel feed response time requires fine adjustment based on acceleration and other parameters.

An object of the present invention is to provide a fuel injection controlling method for an internal combustion engine wherein optimal acceleration characteristics can be obtained.

Another object of the present invention is to provide a fuel injection controlling method for an internal combustion engine wherein fuel increment depending on the state of a running engine excepting the water temperature can be adjusted.

Another object of the present invention is to provide a fuel injection controlling method for an internal combustion engine wherein delayed fuel feed can be adjusted.

Another object of the present invention is to provide a fuel injection controlling method for an internal combustion engine wherein acceleration matching between the state after deceleration and the state after normal becomes possible.

Another object of the present invention is to provide a fuel injection controlling method for an internal combustion engine wherein speed up revolution time of acceleration from idling to the fully open state under no load can be shortened.

Another object of the present invention is to provide a fuel injection controlling method for an internal combustion engine wherein inadequate acceleration during rapid acceleration which is to be effected after fuel reduction for deceleration can be improved.

In accordance with the present invention, a fuel injection controlling method for an internal combustion engine is provided which includes: controlling the opening time of fuel injector in accordance with the control content previously programmed based on various operational parameters including air intake volume, the number of revolutions and temperature of the engine; measuring the air intake volume by a hot wire air flow meter; generating a signal of an idle switch for detecting a closed state of a throttle valve adapted to control the intake air amount; and generating a valve opening pulse for a fuel increment independently of a valve opening pulse for causing the injector to inject fuel normally during the normal condition. The valve opening pulse for a fuel increment has a duration dependent on at least one of selected variations in the air intake volume per unit time, a closing signal for the throttle valve, a signal indicating the number of revolutions of the internal combustion engine, etc., independently of the duration of the basic valve opening pulse.

It is possible to obtain optimum acceleration by varying the adjustment depending on conditions for interrupt adjustment during acceleration. Further, by applying the judgement of conditions for adjustment after fuel reduction for deceleration, it has become possible to acceleration matching between the state after deceleration and the state after normal operation.

DETAILED DESCRIPTION

Figure 1:
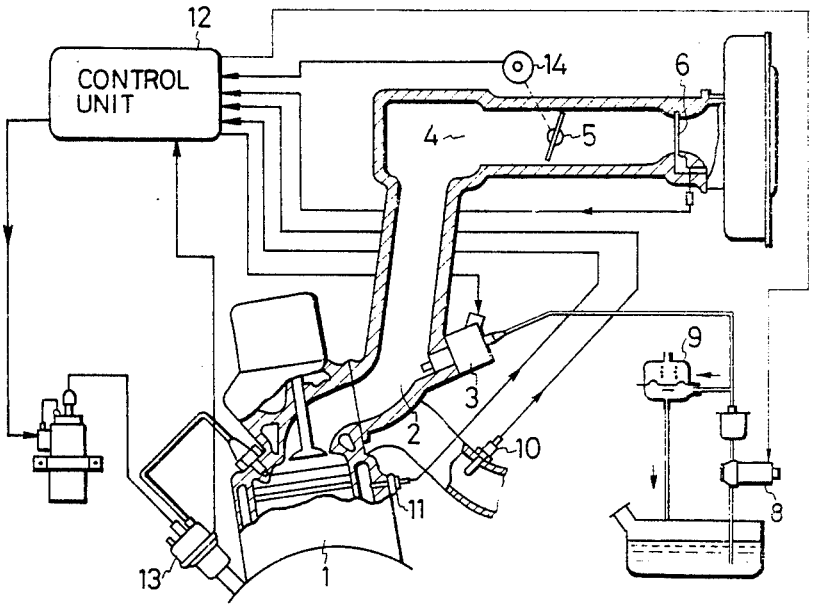
FIG. 1 is a schematic diagram of an engine system embodying the present invention.

Referring now to FIG. 1, an engine system in accordance with the present invention includes an engine 1 having intake pipes 2 provided with the fuel injection valves (injectors) 3 corresponding to the number of cylinders, with the intake pipes 2 being brought into a single pipe at a collector 4 in the upstream side, and having a throttle valve 5 for determining the amount of intake for the engine further upstream.

An amount of intake for the engine 1 is measured by a hot wire air flow meter 6 provided still further upstream, with engine rotational speed or revolutions being counted by a rotational speed sensor 13. In addition to the above, a control unit CU 12 also receives a signal 11 from engine temperature detector, an exhaust gas signal from an oxygen concentration measuring sensor 10, and a signal from an idle switch 14, etc.

Fuel is supplied to the engine 1 by opening a valve on each fuel injector 3, and the amount of fuel is measured based on valve opening time. Fuel is pressurized and regulated by a fuel pump 8 and a regulator 9.

Figure 2:
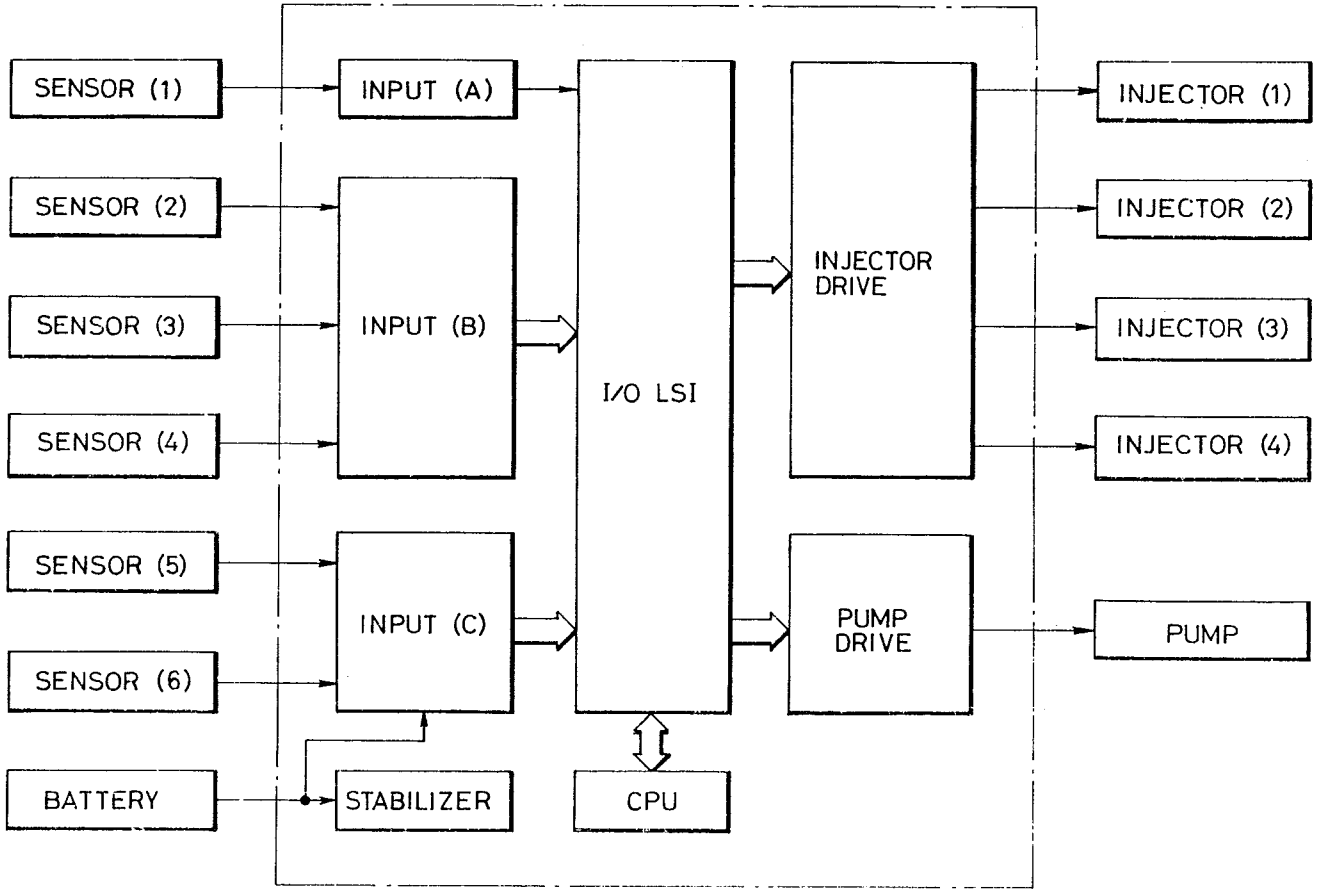
FIG. 2 is a block diagram of a relationship between input and output in the system of FIG. 1.

In the control unit 12, as shown in FIG. 2, wave shaping circuits and AD converters are arranged on the left side, an I/O LSI section for implementing therein exchange of input/output and arithmetic processing and a CPU for giving instructions to the I/O LSI section are at the center, and a circuit for driving the output actuators on the right side.

Figure 3:
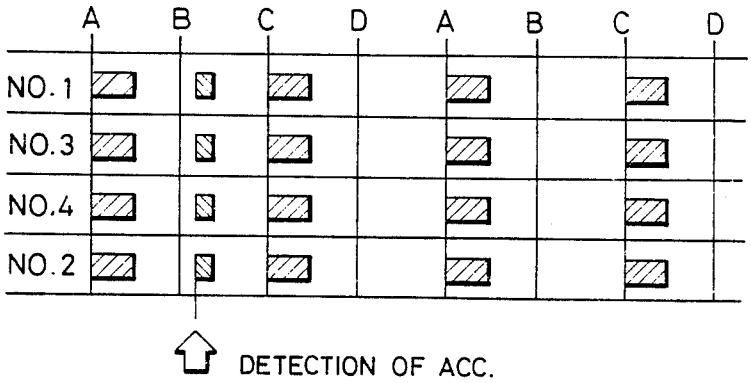
FIG. 3 is a graphical illustration of engine injection timing.

Next, injection timing, for example in a 4-cylinder, 4-cycle engine, will be described with reference to FIG. 3. In the 4-cylinder, 4-cycle engine, fuel is usually injected once per revolution, i.e., at the timing of A and C, for all four cylinders.

The sections A and C are respectively the basic valve opening pulses for causing the injector to inject fuel normally during the normal condition.

A fuel increment pulse (interrupt pulse) described in the present invention is a pulse shown in the section of B which is generated immediately upon detection of acceleration, so as to inject fuel at that time.

In the present invention, acceleration may be detected based on, for example, an ON→OFF signal of the idle switch 14 or a closing signal of the idle switch 14 indicating that a throttle valve 5 has been opened from an idle state, and the rate of variation (ΔQa) of the air intake volume Qa per unit time. The magnitude of acceleration can be detected based on the value (ΔQa/Qa) of the rate of variation of the air intake volume Qa during a predetermined time (Δt).

Table 1 shows an example of setting the fuel increment pulse (interrupt pulse) to a running vehicle in response to the magnitude of acceleration.

TABLE 1

| Condition before Acceleration | Magnitude of Acceleration | Interrupt Pulse After Idling | Interrupt Pulse ΔQa |
|---|---|---|---|
| Fuel Cutdown for Deceleration | 5% < ΔQa < 37.5% (Under Light Load) | 9 ms | 3 ms |
| | ΔQa ≧ 37.5 | 9 ms | 9 ms (max. 4 times) |
| Normal (Idle Sw. Off) | 5% < ΔQa < 10% (Under Light Load) | — | 3 ms |
| | ΔQa ≧ 10% | — | 6 ms |
| Normal (Idle Sw. On) | 5% < ΔQa < 10% (Under Light Load) | 3 ms | 3 ms |
| | ΔQa ≧ 10% | 3 ms | 6 ms |

By way of example, the process after acceleration is divided depending on the condition before acceleration. More specifically, after reducing fuel feed during deceleration, a large amount of fuel must be supplied to compensate for drying-up in the intake system during fuel reduction. Also after the normal condition, adjusting acceleration requires changes to correspond to the fully closed state of the throttle valve and other states thereof.

Further, acceleration is detected as a combination of the rate of variation (ΔQa) in the air intake volume per unit time and the idle switch setting. In Table 1, the legend "after idling" indicates an interrupt pulse based on detection of acceleration using the idle switch.

The reason for detecting acceleration based on both the idle switch and the rate of variation (ΔQa) in the air intake volume per unit time is in that detection with the idle switch always occurs earlier than detection with the rate of variation (ΔQa) in the air intake volume per unit time. Experiments have shown that this is attributable to a delay in the intake system accompanying detection of the rate of variation (ΔQa) in the air intake volume per unit time. Though this delay is relatively short, it is still longer than that accompanying the opening of the throttle valve.

Description will now be made by referring to typical examples of the respective cases. The interrupt pulse based on the rate of variation (ΔQa) in the air intake volume per unit time after fuel cutdown for deceleration will be described.

First, after fuel reduction for deceleration, the process is divided into slow acceleration (under light load. 5%<ΔQa<37.5%) and rapid acceleration (ΔQa≧37.5%). For slow acceleration, an interrupt pulse of 3 ms is generated; for rapid acceleration, interrupt pulses of 9 ms are generated, (one for each detected acceleration rate).

The magnitudes of the above interrupt pulses are set preferably to have about 1.5~5 ms duration for slow acceleration and to have about 6~12 ms duration for rapid acceleration, respectively.

An interrupt pulse based on the idle switch is set to have, by way of example, a relatively long duration of 9 ms. The magnitude of the above interrupt pulse by the after idling is set preferably to have about 6–12 ms duration.

An interrupt pulse based on the rate of variation (ΔQa) in the air take volume per unit time in normal condition is set to have a 3 ms duration for slow acceleration (5%<ΔQa<10%) and is set to have a 6 ms duration for rapid acceleration (ΔQa≧10%) respectively, and the fuel is injected. The magnitudes of the above interrupt pulses are set preferably to have about 1.5~5 ms duration for slow acceleration and to have above 4~8 ms duration for rapid acceleration, respectively.

After the normal condition the idle switch is turned on, because the intake pipe does not dry as much as before, an interrupt pulse based on the idle switch may be set to a shorter duration, e.g., 3 ms, than that during deceleration. The magnitude of the above interrupt pulse is set preferably to have 1.5~5 ms duration.

Moreover, in acceleration from the state where the idle switch is turned off, i.e., the throttle valve is in an open state, better conditions exist in comparison with acceleration from a closed state of the throttle valve, in that the mixture in the intake pipe is more uniform, whereby acceleration adjustment based on the idle switch is not required.

Figure 4:
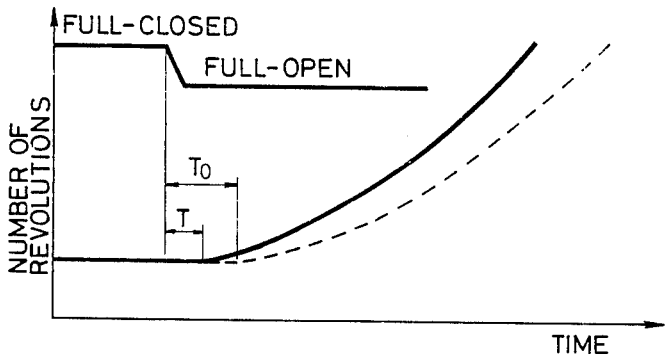
FIG. 4 is a graphical illustration of experimental results of respective speed up revolution times according to both the present invention and the prior art.

The graph of FIG. 4 represents an example of rapid acceleration from idling to the fully open state under no load. It is evident from FIG. 4 that, as a result of adjusting with the additional interrupt pulses during acceleration, revolution time is speeded up from $T_0$ of about 200 ms in the prior art to T of about 120 ms in the present invention.

Figure 5:
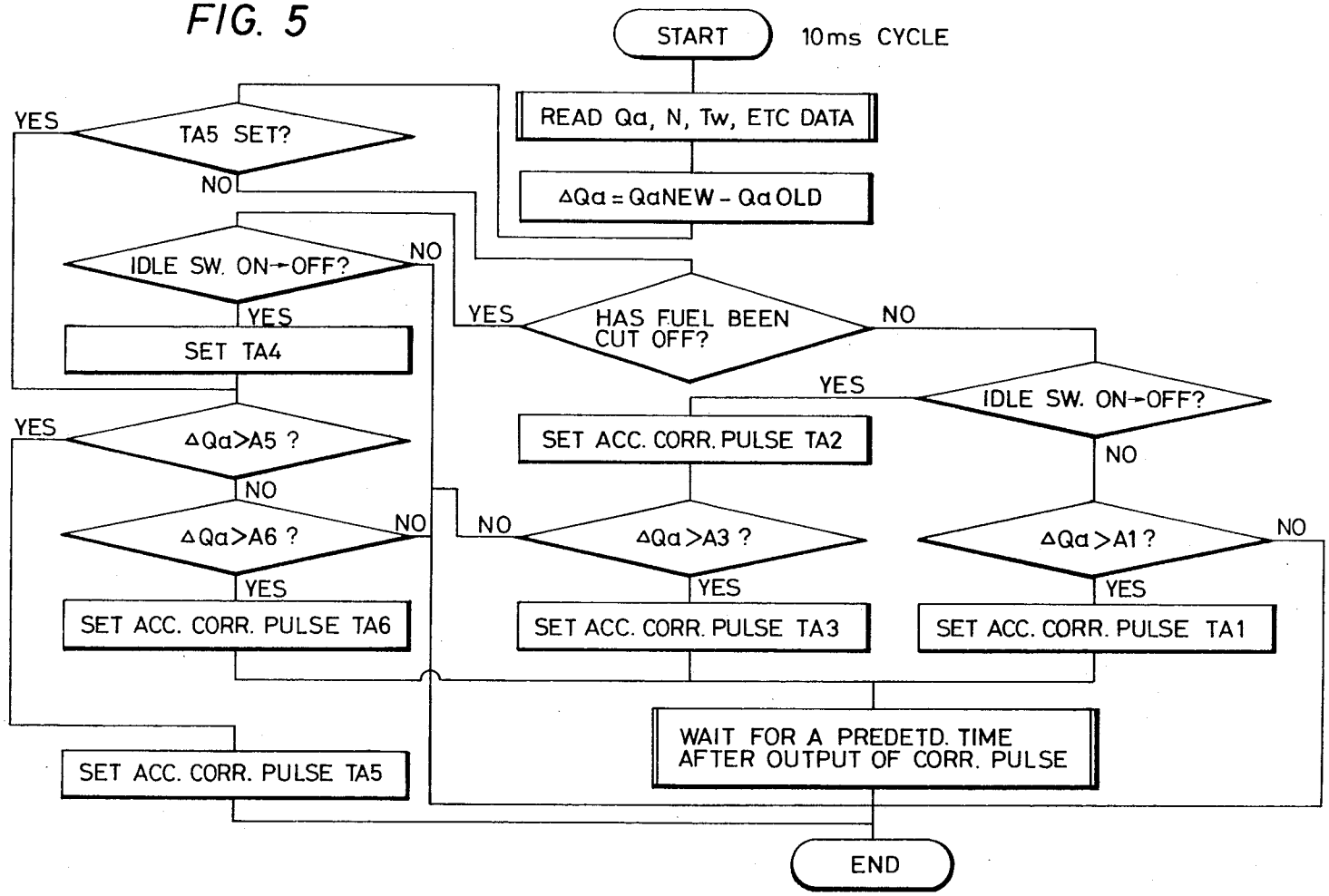
FIG. 5 is a flow chart realizing for depicting the acceleration adjusting method of the present invention.

FIG. 5 shows a flow chart sheet for realizing the adjustment described in connection with Table 1. First, in acceleration after the normal condition, the process flow passes the right-hand loop. When the rate of variation of the air take volume per unit time (ΔQa) is smaller than A1, no interrupt pulse is generated; when ΔQa is greater than A1, an interrupt pulse TA1 is issued. Note that, although inherently a decision must be made based on the inequality of $A_1' > \Delta Qa > A_1''$ so that the additional pulse may be divided into interrupt pulses TA1' (of 6 ms in Table 1) and TA1" (of 3 ms in Table 1), this process has been omitted from the flow chart in all the following associated flow.

Next, in the central loop representing acceleration from idling, an interrupt pulse TA2 (3 ms) due to the condition after idling is set and thereafter an interrupt pulse TA3, also herein inherently divided into two types—interrupt pulses TA3', 3 ms in Table 1, and TA3", 6 ms in Table 1—is set based on ΔQa.

The left-hand loop represents acceleration from the decelerated state. In this case, an interrupt pulse TA4 (9 ms) is issued due to the state after idling and acceleration is then determined on the basis of ΔQa. If A5>ΔQa>A6, an interrupt pulse TA6 (3 ms) is issued and adjustment is completed therewith.

In all these adjustments the interrupt pulse based on ΔQa is generated only once for each acceleration; therefore, tests on a running engine have revealed the problem of inadequate acceleration during rapid acceleration which is to be effected after fuel reduction for deceleration.

The present invention is to overcome this problem. Namely, when ΔQa>A5, an interrupt pulse TA5 is set. The fact that the pulse TA5 has been issued is stored in memory, thus making it possible to repeat the adjustment with the interrupt pulse TA5 based on ΔQa>A5 only on the above condition.

What is claimed is:

1. A fuel injection controlling method for an internal combustion engine, the method comprising the steps of:

controlling a duration of opening of a fuel injector valve in accordance with a prestored control program based on various engine operational parameters including air intake volume, the number of revolutions, and the temperature of the engine; measuring the air intake volume of the engine; generating a throttle-closed position signal using an idle switch for indicating a closed state of a throttle valve adapted to control the intake air amount; generating a basic fuel injector valve opening pulse for causing a fuel injector to inject fuel during the operation of the engine; and generating an increment fuel injector valve opening pulse for injecting a fuel increment independent of said basic fuel injector valve opening pulse during acceleration of the engine, wherein said increment fuel injector valve opening pulse has an opening duration which is dependent upon predetermined operating conditions of the engine detected from variations in the air intake volume per unit time and the value of said throttle-closed position signal which occur prior to acceleration.

2. A fuel injection controlling method for an internal combustion engine according to claim 1, wherein said increment fuel injection valve opening pulse is generated immediately when the throttle valve changes from a closed state to an open state as indicated by the value of said throttle-closed position signal.

3. A fuel injection controlling method for an internal combustion engine according to claim 2, wherein said increment fuel injection valve opening pulse has a first duration when the air intake volume per unit time prior to acceleration indicates that the engine is not in a state of deceleration, and wherein said increment fuel injector valve opening pulse has a second duration which is longer than said first duration when the air intake volume per unit time prior to acceleration indicates that the engine is in a state of deceleration.

4. A fuel injection controlling method for an internal combustion engine according to claim 1, wherein, subsequent to generating said increment fuel injector valve opening pulse and during the same cycle, at least one further increment fuel injector valve opening pulse is generated for injecting a further fuel increment, the duration of said further increment fuel injector valve opening pulse being determined at least in part by the magnitude of the rate of change of air intake volume per unit time as measured subsequent to the start of acceleration.

5. A fuel injection controlling method for an internal combustion engine according to claim 4, wherein, when the rate of change of air intake volume per unit time as measured subsequent to acceleration is greater than a predetermined amount, the duration of said further increment fuel injector valve opening pulse is greater when the air intake volume per unit time prior to acceleration indicates that the engine is in a state of deceleration than when said air intake volume per unit time prior to acceleration indicates that the engine is not in a state of deceleration.

6. A fuel injection controlling method for an internal combustion engine, the method comprising the steps of:

controlling a duration of opening of a fuel injector valve in accordance with a prestored control program based on various engine operational parameters including air intake volume, the number of revolutions, and the temperature of the engine; measuring the air intake; generating a throttle-closed position signal using an idle switch for indicating a closed state of a throttle valve adapted to control the intake air amounts; generating a basic fuel injector valve opening pulse for causing a fuel injector to inject fuel during the operation of the engine; and generating an increment fuel injector valve opening pulse for injecting a fuel increment independent of said basic fuel injector valve opening pulse, wherein said increment fuel injector valve opening pulse is generated immediately when the throttle valve changes from a closed state to an open state as indicated by the value of said throttle-closed position signal.

7. A fuel injection controlling method for an internal combustion engine according to claim 6, wherein, subsequent to generating said increment fuel injector valve opening pulse and during the same cycle, at least one further increment fuel injector valve opening pulse is generated for injecting a further fuel increment, the duration of said further increment fuel injector valve opening pulse being determined at least in part by the magnitude of the rate of change of air intake volume per unit time as measured subsequent to the start of acceleration.

* * * * *